US005876170A

United States Patent [19]

Geiser

[11] Patent Number: 5,876,170

[45] Date of Patent: Mar. 2, 1999

[54] METHOD FOR TESTING THE COMPLETENESS OF A BOOK BLOCK INTENDED FOR ADHESIVE BINDING

[75] Inventor: Peter Geiser, Matzingen, Switzerland

[73] Assignee: GRAPHA-Holding AG, Hergiswil, Switzerland

[21] Appl. No.: 711,845

[22] Filed: Sep. 10, 1996

[30] Foreign Application Priority Data

Sep. 13, 1995 [CH] Switzerland ..... 02 588/95-2

[51] Int. Cl.[6] ..... B42C 9/00; B42C 13/00

[52] U.S. Cl. ..... 412/8; 412/1; 412/6; 412/9; 412/12; 412/13; 412/14; 412/20; 412/33; 412/901

[58] Field of Search ..... 412/1, 4, 6, 5, 412/8, 9, 11, 12, 13, 17, 14, 18, 19, 20, 21, 22, 33, 34, 37, 901; 270/52.18, 58.08, 58.09

[56] References Cited

U.S. PATENT DOCUMENTS

| | | | |
|---|---|---|---|
| 3,622,147 | 11/1971 | Mebus . | |
| 3,973,787 | 8/1976 | Staats et al. | 281/21 |
| 4,799,661 | 1/1989 | Nail | 270/54 |
| 4,904,138 | 2/1990 | Champeaux et al. | 412/8 |
| 4,923,189 | 5/1990 | Nail | 270/54 |
| 5,078,425 | 1/1992 | Crudo | 281/21.1 |
| 5,193,962 | 3/1993 | Parker et al. | 412/8 |
| 5,252,018 | 10/1993 | Kitahara et al. | 412/13 |
| 5,429,468 | 7/1995 | Kojima | 412/19 |
| 5,441,375 | 8/1995 | Hawkes | 412/4 |

FOREIGN PATENT DOCUMENTS

| | | | |
|---|---|---|---|
| 0 337 291 | 10/1989 | European Pat. Off. . | |
| 3613120A1 | 10/1987 | Germany . | |
| 2141666 | 1/1985 | United Kingdom | 412/4 |

*Primary Examiner*—Frances Han
*Attorney, Agent, or Firm*—Venable; George H. Spencer; Robert Kinberg

[57] ABSTRACT

A method and an arrangement are provided for checking completeness of a book block intended for an adhesive binding, wherein an adhesive binding machine includes a conveyor defining a conveying path along which the book block is conveyed. A plurality of processing stations are arranged along the conveyor for processing the book block. A measuring device is disposed along the conveyor and is adapted to check completeness of the book block by measuring the thickness of the book block. The measuring device includes measuring elements arranged opposite each other on both sides of the conveying path. The measuring elements are separated by a distance to define a measuring segment and arranged for exerting a defined contact pressure onto the flanks of the spine of the book block.

14 Claims, 1 Drawing Sheet

METHOD FOR TESTING THE COMPLETENESS OF A BOOK BLOCK INTENDED FOR ADHESIVE BINDING

CROSS-REFERENCE TO RELATED APPLICATIONS

The present application claims the right of priority of application No. CH 02588/95-2 filed in Switzerland on Sep. 13, 1995, the disclosure of which is incorporated herein by reference.

BACKGROUND OF THE INVENTION

The invention relates to a method for measuring the completeness of a book block intended for adhesive binding by measuring the thickness of the book block passing on a conveyor through processing stations of an adhesive binding machine and comparing a measured actual measured value with a specific control value. The invention additionally relates to an arrangement for carrying out such a method.

For adhesive binding of printed sheets to form a book block (as used herein, the term "book block" includes a book block, per se, and a book, which is a book block with a cover), the individual printed sheets are deposited by sheet feeders of a gathering machine in a channel, in the correct sequence, one above the other to form loose blocks. In a transfer channel, these blocks are subsequently placed to stand on the folded edges of the printed sheets and are transferred to clamping devices of a conveyor that passes through the processing stations of an adhesive binding machine.

The mounted blocks with their folded edges project several millimeters over the clamping devices, so that they can be processed along this strip, which is referred to as an overhang.

At the various successively following stations of the adhesive binding machine, the book blocks are cut, notched, cleaned and glued together. Afterwards, they are generally provided with a slip fold or cover and are subjected to a drying or cooling to accelerate the hardening process, depending on whether hot-melt or cold-setting adhesive is used.

The completeness and correctness of the gathered printed sheets is checked in the gathering machine, in particular in the feeders, so that blocks with missing or excess printed sheets can be removed and/or replaced.

Based on experience, the control devices provided on the feeders are not capable of ensuring that a book block is complete, so that blocks formed from gathered printed sheets can reach the adhesive binding machine in error and are there processed as final products.

SUMMARY OF THE INVENTION

It is thus an object of the invention to provide a method, and an arrangement for carrying out the method, with which the completeness of a loose or glued together book block, including a book block provided with a cover can be checked.

The above and other objects of are accomplished according to the invention by the provision of a method for checking completeness of a book block intended for an adhesive binding, the book block having a spine and flanks on either side of the spine, the method comprising: moving the book block on a conveyor through processing stations of an adhesive binding machine; measuring a thickness of the book block during the moving step with a measuring device that applies a defined contact pressure at the flanks of the spine of the book block; and comparing a measured actual value of the thickness with a desired control value.

The method of the invention permits an exact measuring at the book blocks within the adhesive binding machine, so that an additional station that would extend the adhesive binding machine can be avoided.

The flanks of the spine are advantageously determined by the amount of overhang of a book block at clamping devices that are attached to the conveyor.

An arrangement which is particularly suited for carrying out the method includes an adhesive binding machine with several processing stations arranged along a conveyor and a measuring device to check the completeness by measuring the thickness of a book block, and which is distinguished by measuring elements, installed opposite each other on both sides of the conveying path formed by the conveyed book blocks, which apply a defined contact pressure to the flanks of the spine of the book block.

The arrangement according to the invention is advantageously designed so that the measuring elements can be moved with the book block, parallel to the conveying path, so that reliable values can develop.

The measuring device is advisably fastened to a circulating or endlessly circulating traction element, for which the belt run that is approaching the clamping devices moves in the same direction and at the same speed as the latter.

Alternatively, the measuring elements of the measuring device are designed so they can be moved with an oscillating movement along the conveying path, for example by means of a crank drive or driven control track.

It is preferable if at least one of the measuring elements is arranged so that it can be advanced toward one flank of the spine of the book block. This permits use of a relatively simple drive design, wherein a locally fixed measuring element preferably has an intake guide that discharges into the measuring area.

Because of the small overhang from the clamping devices, it is preferable if the measuring elements have strip-type adjustment edges, which can rest against the flanks. The distance between the adjustment edges of the clamping devices constitutes a measuring segment or gap.

The measuring elements can alternatively comprise rotatable, circular disks and the measuring segment can preferably be the distance between the rotational axes of the disks.

Preferably, the measuring device is connected to a computer which compares the measured actual value with a desired control value, with the result being utilized for analysis.

In order to use the results of the comparison, the computer can be connected to a control device which, for example, triggers the early removal of a defective product.

The arrangement according to the invention can be placed selectively either before, between or after the processing stations of an adhesive binding machine.

It is advisable if the measuring device is designed as part of a cover feeder, which makes it possible to perform two functions at one processing station and therefore avoid extending the adhesive binding machine.

It is further advisable if the measuring elements of the measuring devices are designed as contact pressure elements on the cover feeder.

The invention is explained below with the aid of two exemplary embodiments and by referring to the accompanying drawings, which may be referred to with respect to all details not explained further in the description.

DETAILED DESCRIPTION OF THE PREFERRED EMBODIMENT

Figure 1:
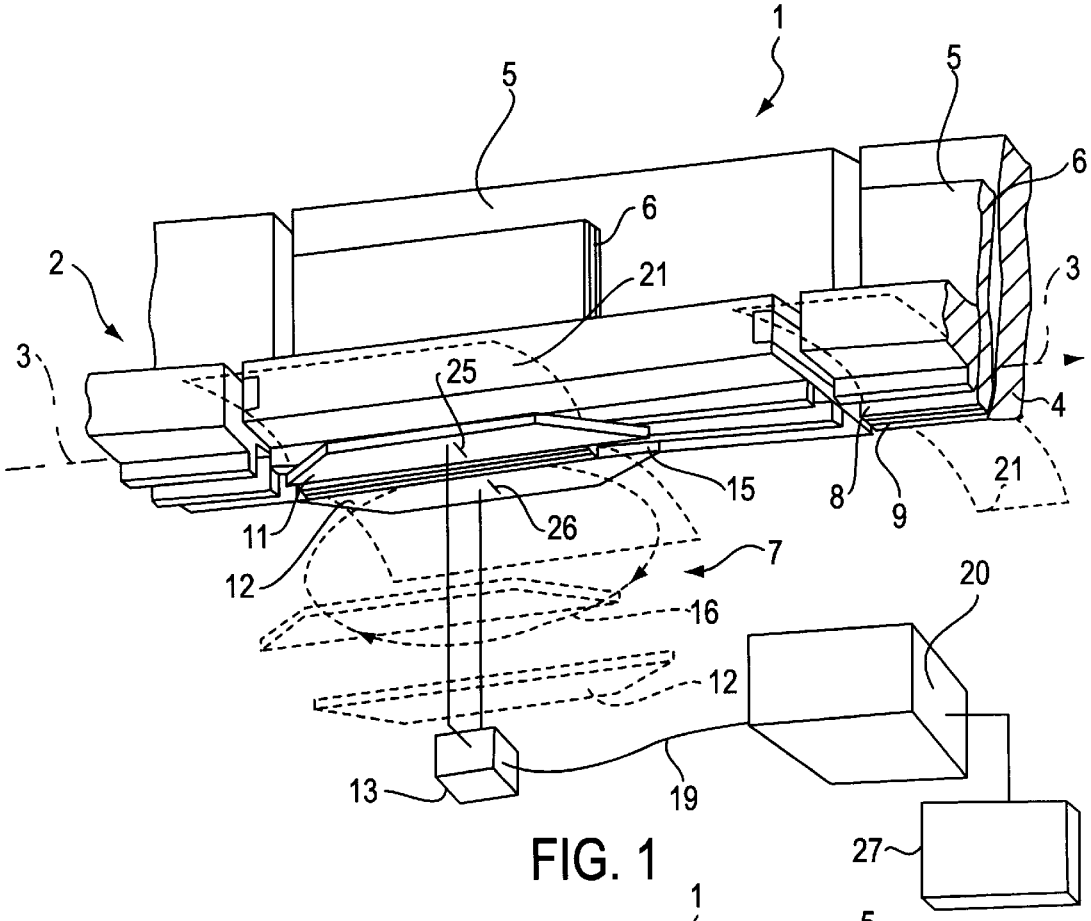
FIG. 1 is perspective view in partial section of a conveyor for an adhesive binding machine with a measuring device in accordance with the invention.

Referring to FIG. 1, there is shown an adhesive binding machine 1 including a conveyor 2. Clamping devices 4 are fastened to an endless traction element, represented by a dash-dot line 3, rotating approximately in a horizontal plane. Clamping devices 4 are used to carry printed sheets 6, which are gathered in an upstream gathering machine to form so-called book blocks 5, through processing stations arranged along the conveyor. Book blocks 5 come from a transfer segment and are standing upright with their spine 9 facing down when they are taken over by opened clamping devices 4. The book blocks have flanks 8 on either side of spine 9 that project past the underside of clamping devices 4, presenting an overhang of 5 to 20 mm that is to be processed. During a subsequent processing, the folds of printed sheets 6 are separated from the book blocks 5 by cutting and the remaining surfaces are prepared for an adhesive.

The subsequent application of the adhesive is done with adhesive rollers or a spraying device. Normally, this process is followed by adding a cover to the previously bound book block spine 9 with the aid of a cover feeder. In order to accelerate the hardening of the adhesive, the book block, possibly with the cover attached, subsequently moves through a drying or cooling segment of the adhesive binding machine. To check the completeness of a book block 5 designed for adhesive binding, a method is used which measures the thickness of the book block 5 moving on conveyor 2 through the processing stations of adhesive binding machine 1 and compares the measured actual value with a desired control value. The thickness measurement is made with a defined contact pressure applied by a measuring device 7 to flanks 8 of a book block 5, possibly already enclosed by a cover.

In accordance with an arrangement for carrying out this method, adhesive binding machine 1, with its several processing stations arranged along the conveyor 2, includes a measuring device 7 which is designed to check the completeness of a book block 5. Measuring device 7 includes measuring elements 11, 12 installed opposite each other on both sides of the conveying path formed by the transported book blocks 5, which are driven perpendicularly to flanks 8 and are applied to flanks 8 with a defined contact pressure. In addition to measuring elements 11, 12, measuring device 7 includes a powered measuring sensor 13 for registering the measured values corresponding to thickness at the overhang. Measuring elements 11, 12 can comprise trapezoid-shaped panels with facing longitudinal edges. As shown, one of the panels, namely panel 11 has a longitudinal edge 15 which constitutes a strip-type adjustment edge which is adjusted to conform to the measuring segment or gap determined by the thickness of the overhang.

The thickness is measured by the position of the oppositely installed measuring elements 11, 12, at least one of which is designed such that it can be adjusted. During a measuring operation, measuring elements 11, 12 travel along with the book blocks 5 to be measured, so that the adhesive binding process does not have to be interrupted.

FIG. 1 shows one embodiment for the measuring procedure in that measuring elements 11, 12, respectively, are moved along a circular path 16 by a drive mechanism schematically represented by the circular path 16, so that directly before and during the measuring operation, the measuring elements move at the same speed as the book block 5 to be measured.

Preferably, the circular path 16 and the contact pressure for the measuring elements 11, 12 are adjustable, or the contact pressure is adjustable by adjusting the circulating path.

Alternatively, measuring elements 11, 12 of the measuring device 7 can be moved in an oscillating manner along the conveying path for book blocks 5, meaning that during the measuring operation, measuring elements 11, 12 have the same speed and move in the same direction as the book blocks 5 and are returned to their starting position after the opening. The measuring takes place by advancing at least one of the measuring elements 11, 12 in a direction perpendicular to the conveying path for the book blocks as shown by double arrows 25, 26.

Figure 2:
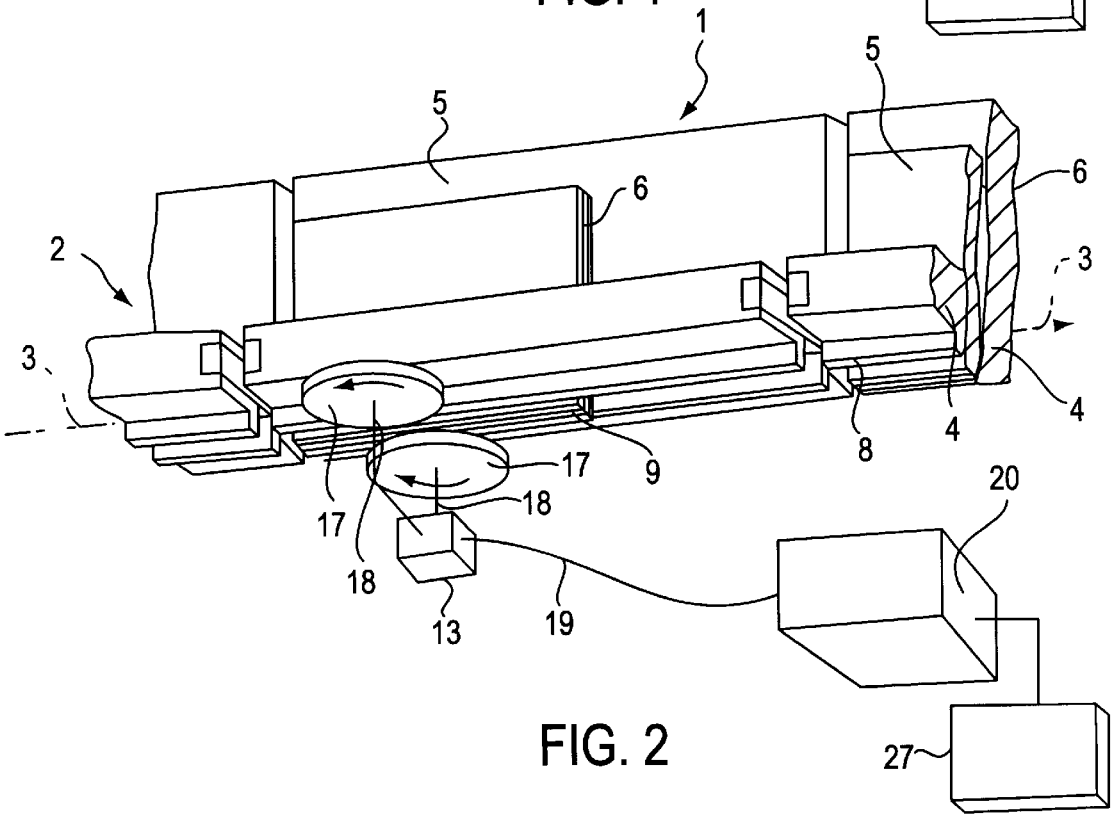
FIG. 2 is a perspective view in partial section of a conveyor similar to that shown in FIG. 1 showing another embodiment of a measuring device according to the invention.

Referring to FIG. 2, there is shown an alternative embodiment for the measuring device, wherein circular, freely rotatable disks 17 are pressed against flanks 8 of the overhang of a book block 5 with a defined force. The measured value can, for example, be detected by the variable distance of the axes of the rotating axles 18 for disks 17.

In both FIGS. 1 and 2, measuring sensor 13 is connected by a line 19 to a computer 20 where the measured actual value is compared to the control value and the result is analyzed. The result of the comparison may be output to a controller 27 which, for example, may be responsive to the comparison result for removing a defective book block from the conveyor.

FIG. 1 furthermore shows a cover 21 with dash-dot line, which is glued to the spine 9 of a book block and to flanks 8. This is done with a so-called cover feeder, which picks up the prepared covers from a stack and places them against the spine 9 of a book block 5 in a known manner.

For an economic design of the suggested arrangement, it is advisable if measuring device 7 is designed to form a part of the cover feeder, wherein the measuring elements 11, 12 or the disks 17 are designed as contact pressure elements to press the cover from the side against the flanks 8 of spine 9.

The invention has been described in detail with respect to preferred embodiments, and it will now be apparent from the foregoing to those skilled in the art that changes and modifications may be made without departing from the invention in its broader aspects, and the invention, therefore, as defined in the appended claims, is intended to cover all such changes and modifications as fall within the true spirit of the invention.

What is claimed is:

1. A method for checking completeness of a book block intended for an adhesive binding, the book block having a spine and flanks on either side of the spine, the method comprising:

moving the book block on a conveyor through processing stations of an adhesive binding machine;

measuring a thickness of the book block during the moving step with a measuring device that applies a defined contact pressure at the flanks of the spine of the book block; and comparing a measured actual value of the thickness with a desired thickness value and producing a control signal which is a function of a difference between the measured actual thickness value and desired thickness value.

2. A method according to claim 1, wherein a clamping device is attached to the conveyor and the moving step includes clamping the book block with the clamping device so that the book block has an overhang from the clamping device, the overhang comprising the spine and the flanks.

3. An arrangement for checking completeness of a book block intended for an adhesive binding, the book block having a spine and flanks on either side of the spine, comprising:

an adhesive binding machine including a conveyor defining a conveying path along which the book block is conveyed and a plurality of processing stations arranged along the conveyor for processing the book block;

a measuring device disposed along the conveyor and adapted to check completeness of the book block by measuring the thickness of the book block and outputting a measured actual value of thickness of the book block, the measuring device including measuring elements arranged opposite each other on both sides of the conveying path, the measuring elements being separated by a distance to define a measuring segment and arranged for exerting a defined contact pressure onto the flanks of the spine of the book block; and a comparator having an input for receiving the measured actual value for comparing the measured actual value with a desired thickness value and outputting a control signal which is a function of a difference between the measured actual value and the desired value.

4. An arrangement according to claim 3, and further including means for moving the measuring elements parallel to the conveying path for traveling with the book.

5. An arrangement according to claim 4, wherein the moving means moves the measuring elements along endless circulating paths that approach the conveying path of the book block and at the speed of the book block on the conveyor while the measuring device measures the thickness of the book block.

6. An arrangement according to claim 3, further including means for moving the measuring elements of the measuring device with an oscillating movement.

7. An arrangement according to claim 3, wherein the measuring elements comprise rotatable, circular disks.

8. An arrangement according to claim 3, wherein at least one of the measuring elements is arranged so that it can be advanced toward a flank of the spine of a book block.

9. An arrangement according to claim 8, wherein the measuring elements have strip-type adjustment edges.

10. An arrangement according to claim 3, wherein the comparator includes a computer connected to the measuring device for comparing the measured actual value to the desired value stored in the computer.

11. An arrangement according to claim 10, further comprising a controller connected to the computer and being responsive to a result of the comparison between the measured value and the desired value in the computer.

12. An arrangement according to claim 3, wherein the measuring device is located before, between or after the processing stations of the adhesive binding machine.

13. An arrangement according to claim 3, wherein one of the processing stations is a cover feeder arranged along the conveyor, and the measuring device is part of the cover feeder.

14. An arrangement according to claim 13, wherein the measuring elements comprise contact pressure elements of the cover feeder that apply pressure from the side of the book block.

* * * * *